US009021949B2

(12) United States Patent
Biegelsen

(10) Patent No.: US 9,021,949 B2
(45) Date of Patent: May 5, 2015

(54) DAMPENING FLUID RECOVERY IN A VARIABLE DATA LITHOGRAPHY SYSTEM

(75) Inventor: David K. Biegelsen, Portola Valley, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 646 days.

(21) Appl. No.: 13/366,947

(22) Filed: Feb. 6, 2012

(65) Prior Publication Data

US 2013/0199387 A1 Aug. 8, 2013

(51) Int. Cl.

| | |
|---|---|
| ***B41F 7/24*** | (2006.01) |
| ***B41C 1/10*** | (2006.01) |
| *B41N 3/08* | (2006.01) |

(52) U.S. Cl.

CPC ... *B41C 1/10* (2013.01); *B41F 7/24* (2013.01); *B41N 3/08* (2013.01)

(58) Field of Classification Search

CPC ..... B41C 1/10; B41C 1/1033; B41C 1/1008; B41F 7/24; B41F 7/26; B41F 19/007; B41N 19/007

USPC ..... 101/452

See application file for complete search history.

(56) References Cited

U.S. PATENT DOCUMENTS

| | | | |
|---|---|---|---|
| 3,741,118 | A | 6/1973 | Carley |
| 3,800,699 | A | 4/1974 | Carley |
| 3,877,372 | A | 4/1975 | Leeds |
| 4,452,139 | A | 6/1984 | Dahlgren |
| 4,527,471 | A | 7/1985 | Dahlgren |
| 4,627,349 | A | 12/1986 | Claussen |
| 4,887,528 | A | 12/1989 | Ruge |
| 5,067,404 | A | 11/1991 | Frunder et al. |
| 5,701,815 | A | 12/1997 | Bocko |
| 5,855,173 | A | 1/1999 | Chatterjee et al. |

(Continued)

FOREIGN PATENT DOCUMENTS

| | | | |
|---|---|---|---|
| DE | 101 60 734 | A1 | 7/2002 |
| DE | 103 60 108 | A1 | 7/2004 |

(Continued)

OTHER PUBLICATIONS

Shen et al., "A new understanding on the mechanism of fountain solution in the prevention of ink transfer to the non-image area in conventional offset lithography", J. Adhesion Sci. Technol., vol. 18, No. 15-16, pp. 1861-1887 (2004).

(Continued)

*Primary Examiner* — Judy Nguyen
*Assistant Examiner* — Jennifer Simmons
(74) *Attorney, Agent, or Firm* — Ronald E. Prass, Jr.; Prass LLP

(57) ABSTRACT

In a variable data lithography system that employs a patterned dampening fluid layer for image formation, dampening fluid may be removed prior to image transfer to a substrate. Removed dampening fluid may be recovered and recycled to reduce operating expenses and environmental waste. A replacement fluid may be applied after inking and after removal of the dampening fluid. The replacement fluid preferentially occupies the regions previously occupied by dampening fluid, and may lubricate the transfer nip. Any replacement fluid and ink not transferred to the substrate upon printing may then be cleaned from the print image carrier prior to forming a new dampening fluid layer and subsequent pattern formation.

11 Claims, 6 Drawing Sheets

(56) References Cited

U.S. PATENT DOCUMENTS

| | | | | |
|---|---|---|---|---|
| 6,125,756 | A | 10/2000 | Nussel et al. | |
| 6,146,798 | A | 11/2000 | Bringans et al. | |
| 6,318,264 | B1 | 11/2001 | D'Heureuse et al. | |
| 6,561,090 | B1 | 5/2003 | Spooner | |
| 6,725,777 | B2 | 4/2004 | Katano | |
| 6,841,366 | B1 | 1/2005 | Bower et al. | |
| 6,901,853 | B2 | 6/2005 | Baldy et al. | |
| 7,020,355 | B2 | 3/2006 | Lahann et al. | |
| 7,061,513 | B2 | 6/2006 | Katano et al. | |
| 7,100,503 | B2 | 9/2006 | Wiedemer et al. | |
| 7,191,705 | B2 | 3/2007 | Berg et al. | |
| 2003/0167950 | A1 | 9/2003 | Mori | |
| 2004/0011234 | A1 | 1/2004 | Figov | |
| 2005/0115429 | A1* | 6/2005 | Link | 101/463.1 |
| 2005/0178281 | A1 | 8/2005 | Berg et al. | |
| 2005/0258136 | A1 | 11/2005 | Kawanishi | |
| 2006/0152566 | A1 | 7/2006 | Taniuchi | |
| 2007/0199457 | A1 | 8/2007 | Cyman, Jr. et al. | |
| 2007/0199458 | A1 | 8/2007 | Cyman, Jr. et al. | |
| 2007/0199459 | A1 | 8/2007 | Cyman, Jr. et al. | |
| 2007/0199460 | A1 | 8/2007 | Cyman, Jr. et al. | |
| 2007/0199461 | A1 | 8/2007 | Cyman, Jr. et al. | |
| 2007/0199462 | A1 | 8/2007 | Cyman, Jr. et al. | |
| 2008/0011177 | A1 | 1/2008 | Muraoka | |
| 2008/0032072 | A1 | 2/2008 | Taniuchi | |
| 2008/0223240 | A1 | 9/2008 | Drury | |
| 2010/0031838 | A1 | 2/2010 | Lewis et al. | |
| 2013/0081549 | A1* | 4/2013 | Stowe | 101/450.1 |
| 2014/0016112 | A1* | 1/2014 | Veres et al. | 355/77 |

FOREIGN PATENT DOCUMENTS

| | | | |
|---|---|---|---|
| DE | 10 2006 050744 | A1 | 4/2008 |
| DE | 10 2008 062741 | | 7/2010 |
| EP | 1 935 640 | A2 | 6/2008 |
| EP | 1 938 987 | A2 | 7/2008 |
| EP | 1 964 678 | A2 | 9/2008 |
| EP | 11187189.3 | | 2/2012 |
| EP | 11187192.7 | | 2/2012 |
| EP | 11187193.5 | | 2/2012 |
| EP | 11187190.1 | | 3/2012 |
| EP | 11187191.9 | | 3/2012 |
| EP | 11187195.0 | | 4/2012 |
| EP | 11187196.8 | | 4/2012 |
| GB | 1302080.5 | | 5/2013 |
| WO | 2006/133024 | A2 | 12/2006 |
| WO | WO 2009025821 | A1 | 2/2009 |

OTHER PUBLICATIONS

Katano et al., "The New Printing System Using the Materials of Reversible Change of Wettability", International Congress of Imaging Science 2002, Tokyo, pp. 297 et seq. (2002).
U.S. Appl. No. 13/095,714, filed Apr. 27, 2011, Stowe et al.
U.S. Appl. No. 13/095,737, filed Apr. 27, 2011, Stowe et al.
U.S. Appl. No. 13/095,745, filed Apr. 27, 2011, Stowe et al.
U.S. Appl. No. 13/095,757, filed Apr. 27, 2011, Stowe et al.
U.S. Appl. No. 13/095,764, filed Apr. 27, 2011, Stowe et al.
U.S. Appl. No. 13/095,773, filed Apr. 27, 2011, Stowe et al.
U.S. Appl. No. 13/095,778, filed Apr. 27, 2011, Stowe et al.
U.S. Appl. No. 13/204,515, filed Aug. 5, 2011, Stowe et al.
U.S. Appl. No. 13/204,526, filed Aug. 5, 2011, Stowe et al.
U.S. Appl. No. 13/204,548, filed Aug. 5, 2011, Stowe et al.
U.S. Appl. No. 13/204,560, filed Aug. 5, 2011, Pattekar et al.
U.S. Appl. No. 13/204,567, filed Aug. 5, 2011, Stowe et al.
U.S. Appl. No. 13/204,578, filed Aug. 5, 2011, Stowe et al.
U.S. Appl. No. 13/426,209, filed Mar. 21, 2012, Liu et al.
U.S. Appl. No. 13/426,262, filed Mar. 21, 2012, Liu et al.

* cited by examiner

DAMPENING FLUID RECOVERY IN A VARIABLE DATA LITHOGRAPHY SYSTEM

BACKGROUND

The present disclosure is related to marking and printing methods and systems, and more specifically to methods and systems for recovering a dampening solution (such as water-based fountain fluid) in a variable lithography marking or printing system.

Offset lithography is a common method of printing. (For the purposes hereof, the terms "printing" and "marking" are used interchangeably.) In a typical lithographic process the surface of a print image carrier, which may be a flat plate, cylinder, belt, etc., is formed to have "image regions" of hydrophobic and oleophilic material, and "non-image regions" of a hydrophilic material. The image regions correspond to the areas on the final print (i.e., the target substrate) that are occupied by a printing or marking material such as ink, whereas the non-image regions are the regions corresponding to the areas on the final print that are not occupied by said marking material. The hydrophilic regions accept and are readily wetted by a water-based dampening fluid (commonly referred to as a fountain solution, and typically consisting of water and a small amount of alcohol as well as other additives and/or surfactants). The hydrophobic regions repel dampening solution and accept ink, whereas the dampening solution formed over the hydrophilic regions forms a fluid "release layer" for rejecting ink. Therefore the hydrophilic regions of the printing plate correspond to unprinted areas, or "non-image areas", of the final print.

The ink may be transferred directly to a substrate, such as paper, or may be applied to an intermediate surface, such as an offset (or blanket) cylinder in an offset printing system. The offset cylinder is covered with a conformable coating or sleeve with a surface that can conform to the texture of the substrate, which may have surface peak-to-valley depth somewhat greater than the surface peak-to-valley depth of the imaging plate. Sufficient pressure is used to transfer the image from the offset cylinder to the substrate. Pinching the substrate between the offset cylinder and an impression cylinder provides this pressure.

The above-described lithographic and offset printing techniques utilize plates which are permanently patterned, and are therefore useful only when printing a large number of copies of the same image (long print runs), such as magazines, newspapers, and the like. However, they do not permit creating and printing a new pattern from one page to the next without removing and replacing the print cylinder and/or the imaging plate (i.e., the technique cannot accommodate true high speed variable data printing wherein the image changes from impression to impression, for example, as in the case of digital printing systems). Furthermore, the cost of the permanently patterned imaging plates or cylinders is amortized over the number of copies. The cost per printed copy is therefore higher for shorter print runs of the same image than for longer print runs of the same image, as opposed to prints from digital printing systems.

Lithography and the so-called waterless process provide very high quality printing, in part due to the quality and color gamut of the inks used. Furthermore, these inks—which typically have a very high color pigment content (typically in the range of 20-70% by weight)—are very low cost compared to toners and many other types of marking materials. However, while there is a desire to use the lithographic and offset inks for printing in order to take advantage of the high quality and low cost, there is also a desire to print variable data from page to page. Heretofore, there have been a number of hurdles to providing variable data printing using these inks. Furthermore, there is a desire to reduce the cost per copy for shorter print runs of the same image. Ideally, the desire is to incur the same low cost per copy of a long offset or lithographic print run (e.g., more than 100,000 copies), for medium print run (e.g., on the order of 10,000 copies), and short print runs (e.g., on the order of 1,000 copies), ultimately down to a print run length of 1 copy (i.e., true variable data printing).

One problem encountered is that offset inks have too high a viscosity (often well above 50,000 cps) to be useful in nozzle-based inkjet systems. In addition, because of their tacky nature, offset inks have very high surface adhesion forces relative to electrostatic forces and are therefore almost impossible to manipulate onto or off of a surface using electrostatics. (This is in contrast to dry or liquid toner particles used in xerographic/electrographic systems, which have low surface adhesion forces due to their particle shape and the use of tailored surface chemistry and special surface additives.)

Efforts have been made to create lithographic and offset printing systems for variable data in the past. One example is disclosed in U.S. Pat. No. 3,800,699, incorporated herein by reference, in which an intense energy source such as a laser to pattern-wise evaporate a dampening solution.

In another example disclosed in U.S. Pat. No. 7,191,705, incorporated herein by reference, a hydrophilic coating is applied to an imaging belt. A laser selectively heats and evaporates or decomposes regions of the hydrophilic coating. A water based dampening solution is then applied to these hydrophilic regions, rendering them oleophobic. Ink is then applied and selectively transfers onto the plate only in the areas not covered by dampening solution, creating an inked pattern that can be transferred to a substrate. Once transferred, the belt is cleaned, a new hydrophilic coating and dampening solution are deposited, and the patterning, inking, and printing steps are repeated, for example for printing the next batch of images.

In known systems, following transfer of the inked pattern to the substrate, the cleaning step completely removes the dampening solution and any remaining ink. Thorough and complete cleaning is required to prevent residual elements from prior images ("ghosting") and other artifacts from affecting the image to be printed. Knife-edge cleaning (effectively, scraping) systems, wiper or brush systems, non-contact cleaning process such as high pressure rinsing or solvent cleaning, and other techniques are used to fully clean the print image carrier. However, stripping dampening solution and residual ink together from the print image carrier means that reuse of either dampening solution or ink is impracticable or most commonly not possible.

One possible approach to recovery of dampening solution would be to remove the dampening solution after forming the inked image on the print image carrier but before the transfer nip at which ink is transferred to the substrate. This presents an ink-only interface between the print image carrier and substrate, or a totally fluid-free nip for blank regions of an image. However, it is generally undesirable to expose the print image carrier surface to direct physical contact with the substrate. For example, in embodiments in which the substrate is paper, the abrasive surface of the paper can limit the working lifespan of the print image carrier. Systems and methods are needed to improve the recapture and reuse of the dampening solution without negatively affecting print image quality or image carrier lifespan.

SUMMARY

Accordingly, the present disclosure is directed to systems and methods for providing variable data lithographic and offset lithographic printing, which address the shortcomings identified above—as well as others as will become apparent from this disclosure. The present disclosure concerns subsystems and methods providing dampening fluid reuse without requiring special processing of the dampening fluid to remove residual ink and without directly exposing the print image carrier surface to physical contact with the substrate.

According to one aspect of the present disclosure, a variable data lithographic or offset lithographic printing system includes a multi-stage dampening fluid subsystem in which: a first stage applies dampening fluid layer over a print image carrier, patterns the fluid layer, and inks the patterned fluid layer, as otherwise known; a second stage removes the dampening fluid while leaving the patterned ink in place on the print image carrier; and a third stage deposits a replacement fluid essentially in place of the dampening fluid.

Similarly, according to another aspect of the present disclosure, a method for variable data lithographic or offset lithographic printing includes first applying a dampening fluid layer over a print image carrier, patterning the fluid layer, and inking the patterned fluid layer, as otherwise known; the dampening fluid is next removed, while leaving the patterned ink in place on the print image carrier; and, a replacement fluid is deposited over the print image carrier that essentially takes the place of the dampening fluid.

The replacement fluid coats (largely, but not necessarily completely) the pint image carrier, but does not wet the regions of ink that remain after removal of the dampening fluid. The replacement fluid acts as a lubricant (along with the ink) to reduce wear. Finally, the replacement fluid either totally wicks into the paper, or splits in the transfer nip. Any residual replacement fluid on the print image carrier is either evaporated or removed, for example by air-knife or other appropriate method before removal at the residual ink cleaning subsystem.

Accordingly, a replacement fluid subsystem for use in a variable data lithography system is disclosed, which comprises: a dampening fluid extraction subsystem disposed such that dampening fluid disposed on a print image receiving surface and forming a patterned dampening fluid layer may be removed therefrom with no more than minimal modification to ink deposited in gaps in the dampening fluid layer; and, a replacement fluid deposition subsystem disposed such that replacement fluid deposited thereby may be deposited onto the print image receiving surface preferentially in regions formerly occupied by the dampening fluid prior to its removal by the dampening fluid extraction subsystem, the replacement fluid deposited with no more than minimal modification to the ink deposited in the gaps.

The above is a summary of a number of the unique aspects, features, and advantages of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that description of well-known starting materials, processing techniques, components, equipment and other well-known details are merely summarized or are omitted so as not to unnecessarily obscure the details of the present invention. Thus, where details are otherwise well known, we leave it to the application of the present invention to suggest or dictate choices relating to those details.

Figure 1:
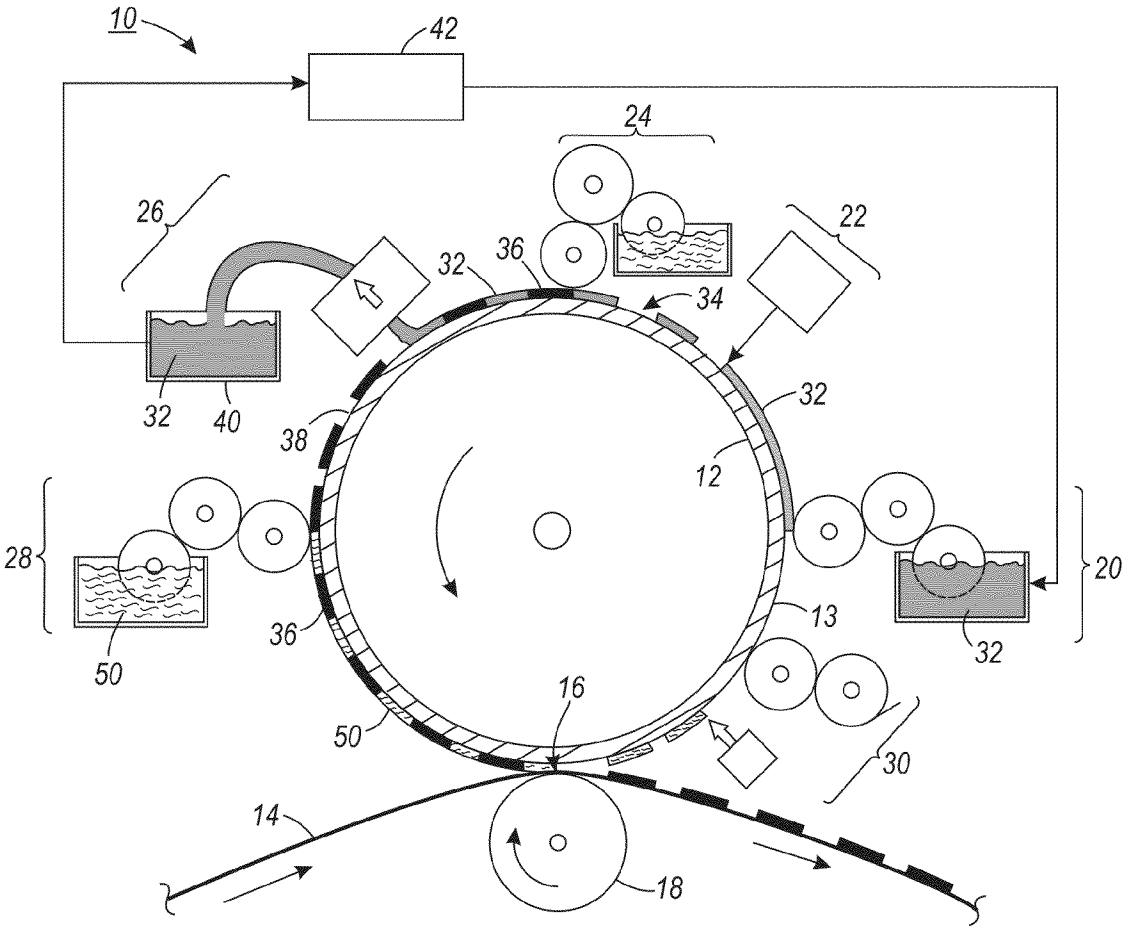
FIG. 1 is a side view of a system for variable lithography according to an embodiment of the present disclosure.

With reference to FIG. 1, there is shown therein a system 10 for variable data lithography according to one embodiment of the present disclosure. System 10 comprises a print image carrier 12, which in this embodiment is a drum, but may equivalently be a plate, belt, etc. Print image carrier 12 has a surface 13, with a number of subsystems located proximate thereto. Print image carrier 12 applies an ink image to substrate 14 at nip 16 where substrate 14 is pinched between print image carrier 12 and an impression roller 18. A wide variety of types of substrates, such as paper, plastic or composite sheet film, ceramic, glass, etc. may be employed. For clarity and brevity of this explanation we assume the substrate is paper, with the understanding that the present disclosure is not limited to that form of substrate. For example, other substrates may include cardboard, corrugated packaging materials, wood, ceramic tiles, fabrics (e.g., clothing, drapery, garments and the like), transparency or plastic film, metal foils, etc. A wide latitude of marking materials may be used including those with pigment densities greater than 10% by weight including but not limited to metallic inks or white inks useful for packaging. For clarity and brevity of this portion of the disclosure we generally use the term ink, which will be understood to include the range of marking materials such as inks, pigments, and other materials that may be applied by systems and methods known or disclosed herein.

The inked image from print image carrier 12 may be applied to a wide variety of substrate formats, from small to large, without departing from the present disclosure. In one embodiment, print image carrier 12 is at least 29 inches wide so that a standard 4-sheet signature page or larger media format may be accommodated. The diameter (or length) of print image carrier 12 must be sufficient to accommodate various subsystems around its peripheral surface. In one embodiment, print image carrier 12 has a diameter of 10 inches, although larger or smaller diameters may be appropriate depending upon the application of the present disclosure. As discussed further below, in one embodiment print image carrier 12 may present an oleophilic surface.

The various subsystems located along the direction of travel of print image carrier 12 include, but are not limited to: a dampening fluid delivery subsystem 20; an optical patterning subsystem 22; an inker subsystem 24; dampening fluid extraction subsystem 26; replacement fluid delivery subsystem 28; and carrier cleaning subsystem. Each of the aforementioned subsystems is discussed further below.

Dampening fluid delivery subsystem 20 generally comprises a series of rollers (referred to as a dampening unit) for uniformly wetting surface 13 of print image carrier 12. It is well known that many different types and configurations of dampening units exist. The purpose of the dampening unit is to deliver a layer of dampening fluid 32 having a uniform and controllable thickness. In one embodiment, this layer is in the range of 0.2 μm to 1.0 μm, and very uniform without pinholes. Typically the dampening fluid 32 may be composed mainly of water, optionally with small amounts of isopropyl alcohol or ethanol added to reduce its natural surface tension as well as lower the evaporation energy necessary for subsequent laser patterning. In addition, a suitable surfactant is ideally added in a small percentage by weight, which promotes a high amount of wetting to the surface of print image carrier 12. Optionally dampening fluid 32 may contain a radiation sensitive dye to partially absorb laser energy in the process of patterning by optical patterning subsystem 22.

It will be further understood that while a water-based solution is one embodiment of a dampening fluid that may be employed in the embodiments of the present disclosure, other non-aqueous dampening fluids with low surface tension, that are oleophobic, are vaporizable, decomposable, or otherwise selectively removable, etc. may be employed. For variable data printing the choice of dampening fluid 32 is constrained by the necessity that it can wet the same surface 13 that the ink 36 can wet, and yet the dampening fluid 32 is not significantly soluble with the ink 13. Relatively few such dampening fluids exist and are generally relatively costly. Furthermore, in the imaging process it is desired that the dampening fluid leaves no residue behind. Thus surfactants are undesirable. To the extent that the dampening fluid consists of multiple fluids it is most desirable that they be azeotropic, so that the recycled vapor will have the same composition as the unused dampening fluid.

One such class of fluids is the class of HydroFluoroEthers (HFE), such as the Novec brand Engineered Fluids manufactured by 3M of St. Paul, Minn. These fluids have the following beneficial properties in light of the current disclosure: (1) lower heat of vaporization than water, requiring lower laser power for patterning (discussed further below) for a given print speed, or higher print speed for a given laser power; (2) lower heat capacity, providing a similar benefit to (1), above; (3) very low post-evaporation residue, enabling improved cleaning performance and/or improved long-term stability; (4) engineerable vapor pressure and boiling point; (5) low surface energy, as required for proper wetting of the imaging member; and, (6) benign in terms of the environment and toxicity. Additional additives may provide control over the electrical conductivity of the dampening solution. Other suitable alternative dampening fluids include fluorinerts and other fluids known in the art, that have all or a majority of the above properties. It is also understood that these types of fluids may not only be used in their undiluted form, but as a constituent in an aqueous non-aqueous solution or emulsion as well. Finally, it will be understood that dampening fluids of the type described above are relatively expensive, and an important cost savings opportunity can be realized through effective recapture and reuse thereof. Furthermore, to the extent that any potentially environmentally harmful materials form a part of the dampening fluid, recapture and reuse thereof can prevent the release of such materials into the environment.

Optical patterning subsystem 22 is used to selectively form an image in dampening fluid 32 by, for example, image-wise (e.g., pixel-by-pixel) evaporating regions of the dampening fluid layer using laser energy. Parameters for controlling the evaporation of dampening fluid 32 are beyond the scope of the present disclosure, and certain details for which may be found, for example, in U.S. patent application Ser. No. 13/095,714, which is incorporated in its entirety by reference herein. It will, however, be understood that a variety of different systems and methods may be used for delivering energy to pattern dampening fluid 32 over surface 13 of print image carrier 12. The particular patterning system and method do not limit the present disclosure.

Inker subsystem 24 is used to apply a low surface energy ink in gaps 34 in dampening fluid 32 formed by patterning system 22 to form ink regions 36. Inker subsystem 24 may consist of a "keyless" system using an anilox roller to meter offset ink onto one or more forming rollers or directly onto the plate surface 13. Alternatively, Inker subsystem 24 may consist of more traditional elements with a series of metering rollers that use electromechanical keys to determine the precise feed rate of the ink. The general aspects of Inker subsystem 24 will depend on the application of the present disclosure, and will be well understood by one skilled in the art.

In order for ink from inker subsystem 24 to initially wet over the surface of print image carrier 12, the ink must have low enough cohesive energy to split onto portions of the print image carrier 12 exposed in gaps 34. In certain embodiments, surface 13 of print image carrier 12 may be purposefully made oleophilic (or more generally having a low interfacial energy with the ink), and/or the ink made sufficiently hydrophobic to be rejected over dampening fluid 32 remaining post-patterning. The dampening fluid itself is of low viscosity and preferentially splits at the exit of the inker nip. Therefore, areas covered by dampening fluid naturally facilitate rejection of the oil-based ink.

Within gaps 34, the cohesive forces between the ink and the print image carrier surface may be controlled such that the adhesive forces between the ink and the surface can be appropriately overcome when the ink in ink regions 36 come into contact with substrate 14 at the exit of nip 16. Again, further details of this process, and various embodiments of systems and methods for appropriate ink deposition may be found in the aforementioned U.S. patent application Ser. No. 13/095,714.

It will now be appreciated that surface 13 of print image carrier 12 has a weak adhesion force to the ink, yet good oleophilic wetting properties with the ink, to promote uniform (free of pinholes, beads or other defects) inking of the surface and to promote the subsequent forward transfer lift off of the ink onto the substrate. Silicone is one material having this property. Other materials providing this property may alternatively be employed, such as certain blends of polyurethanes, fluorocarbons, etc. In terms of providing adequate wetting of dampening solutions (such as water-based fountain fluid), the silicone surface need not be hydrophilic but in fact may be hydrophobic in cases in which wetting surfactants, such as silicone glycol copolymers, are added to the dampening solution to allow the dampening solution to wet the silicone surface.

Figure 2:
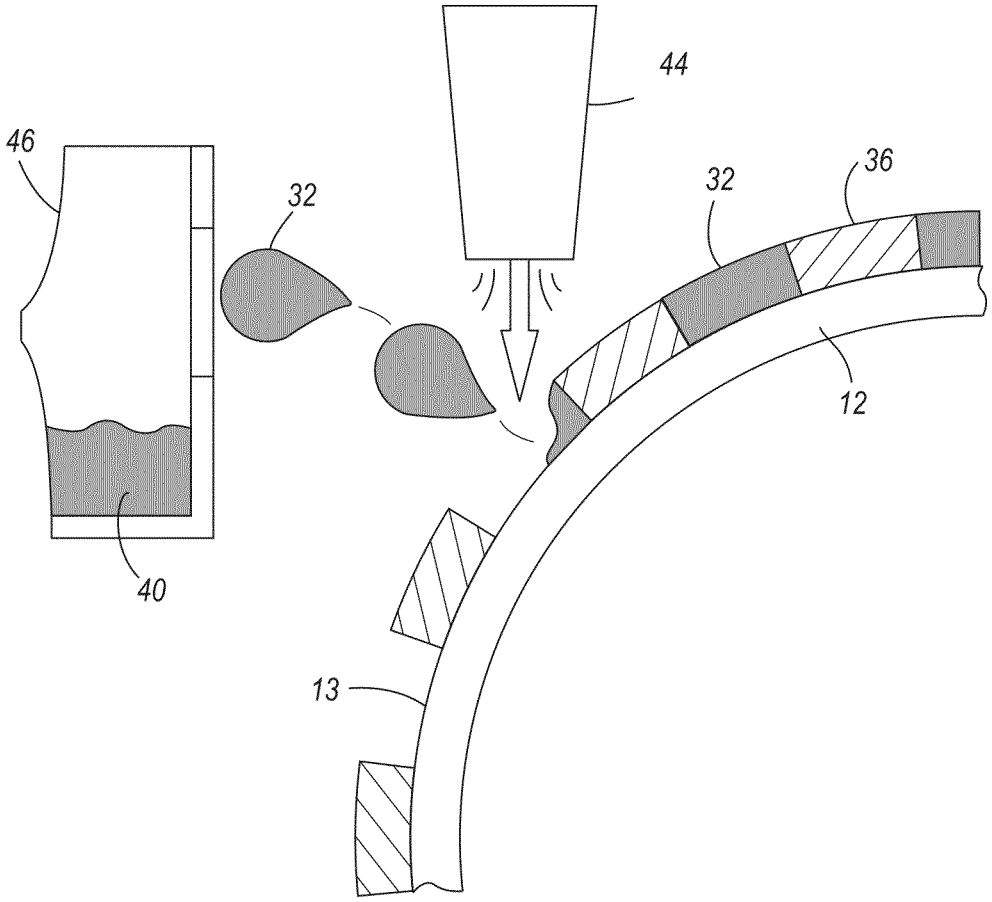
FIG. 2 is a cut-away side view of a portion of a print image carrier, such as an imaging drum, plate or belt, and a portion of an air knife dampening fluid extraction subsystem, according to an embodiment of the present disclosure.
Figure 3:
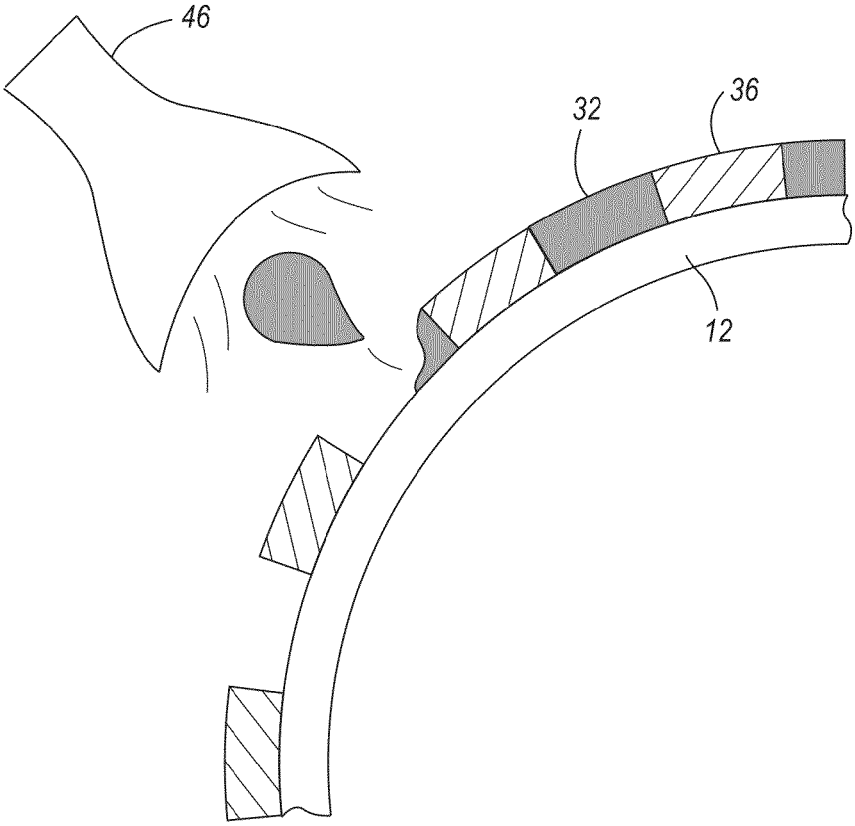
FIG. 3 is a cut-away side view of a portion of a print image carrier, such as an imaging drum, plate or belt, and a portion of a vacuum dampening fluid extraction subsystem, according to an embodiment of the present disclosure.

Dampening fluid extraction subsystem 26 serves to selectively remove the dampening fluid 32 from the surface of print image carrier 12 at this point. A variety of different methods may be used to extract dampening fluid 32. According to one embodiment, illustrated in FIG. 2, a high-speed air knife 44 is used to selectively remove dampening fluid 32, which may be collected by vacuum 46 in reservoir 40. Dampening fluid 32 will separate from print image carrier 12 much more readily than ink in ink regions 36, primarily due to the far lower viscosity and far higher vapor pressure of the dampening fluid 32 relative to the ink 36. Also, due to the aforementioned higher attraction of the oil-based ink than that of the dampening fluid to the oleophilic surface of print image carrier 12 the dampening fluid can be preferentially blown off. Dampening fluid 32 will also relatively cleanly separate from ink in ink regions 36 due to the hydrophobic nature of the ink and the oleophobic nature of the dampening fluid. In still another embodiment, illustrated in FIG. 3, dampening fluid 32 may be removed directly by vacuum 46, which at most minimally disturbs the pattern of ink formed by ink regions 36. It will be appreciated that many other methods and apparatus are contemplated hereby that may be used to remove dampening fluid 32 such that at most the pattern of ink formed by ink regions 36 is only minimally disturbed. Accordingly, the previously formed pattern of ink regions 36 remains on the surface of print image carrier 12, with fluid gaps 38 disposed therebetween.

Returning to FIG. 1, extracted dampening fluid in vapor form is condensed and collected, or if in liquid form simply collected, in reservoir 40. Appropriate methods at recycling apparatus 42 are optionally utilized to remove ink and other contaminants from the dampening fluid. The treated dampening fluid may then be provided back to dampening fluid delivery subsystem 20, for application to the surface of print image carrier 12 as discussed above.

Figure 4:
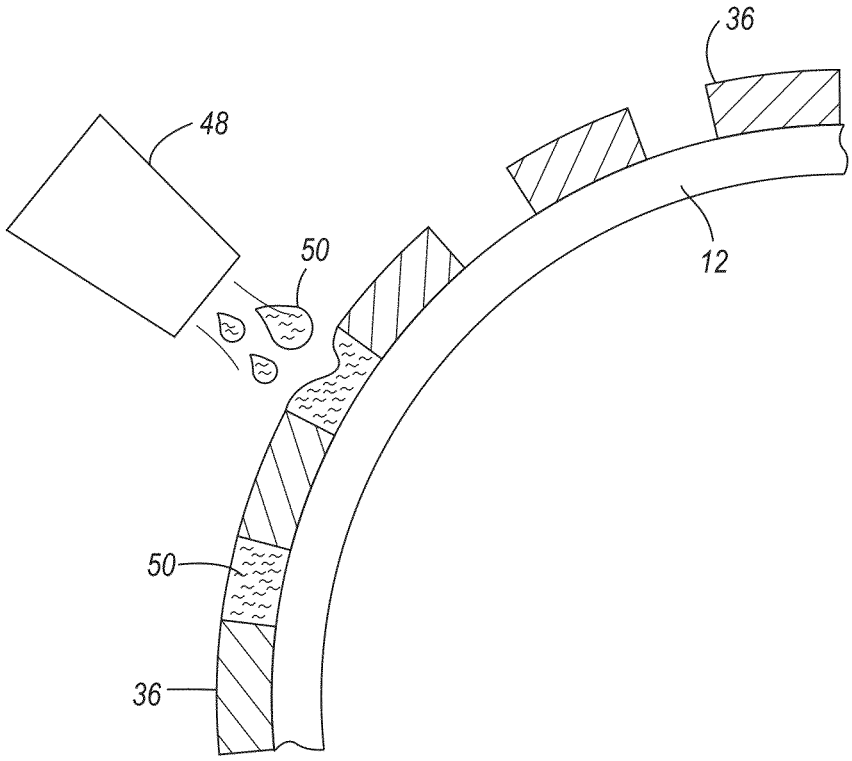
FIG. 4 is a cut-away side view of a portion of a print image carrier, such as an imaging drum, plate or belt, and a portion of a spray replacement fluid delivery subsystem, according to an embodiment of the present disclosure.

The pattern of ink regions 36 remaining on the surface of print image carrier 12 is then brought into proximity of replacement fluid delivery subsystem 28. The mechanics and arrangement of replacement fluid delivery subsystem 28 may be similar to those of dampening fluid delivery subsystem 28, with the exception that particular care is taken to not disturb the pattern of ink regions 36 remaining on the surface of print image carrier 12. In FIG. 1, a roller arrangement disposed to be spaced apart from the surface of print image carrier 12 at least by the thickness of the ink forming ink regions 36. Replacement fluid 50 is delivered to the surface of print image carrier 12 by the roller arrangement. In an alternate embodiment, illustrated in FIG. 4, a spray nozzle 48 delivers the replacement fluid 50 to the surface of print image carrier 12.

In the various embodiments of replacement fluid delivery subsystem 28, the replacement fluid should be repelled by the ink but able to wet the surface of print image carrier 12. Therefore, the replacement fluid will typically be a water-based material so that good separation between the ink and the replacement fluid is facilitated. The replacement fluid must also readily separate from the surface of print image carrier 12 so that it is easy to remove and provide a clean surface to print image carrier 12. In one embodiment, the replacement fluid is free of surfactants, which can plate out and be difficult to clean from surface 13 of print image carrier 12. According to one embodiment, the replacement fluid is a mixture of alcohol and water. According to another embodiment, mixtures with polar silicone fluids are used.

Figure 5:
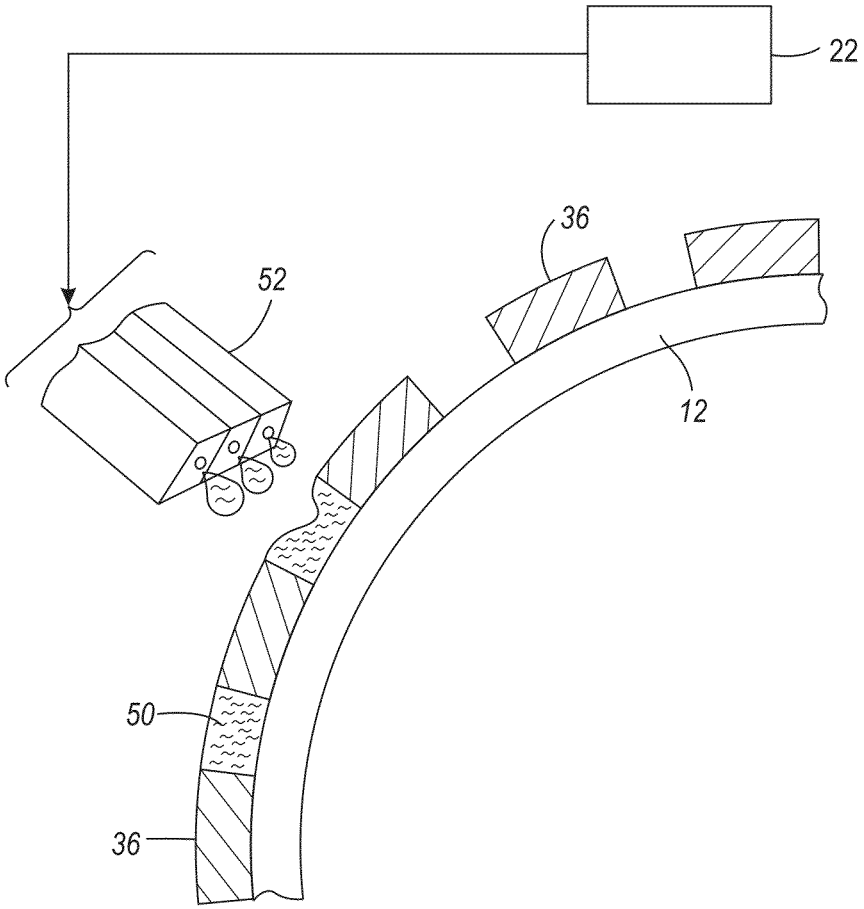
FIG. 5 is a is a cut-away side view of a portion of a print image carrier, such as an imaging drum, plate or belt, and a portion of an ink jet replacement fluid delivery subsystem, according to an embodiment of the present disclosure.

Alternatively, replacement fluid 50 can be deposited in the larger spaces between inked image areas and allowed to ball up. In the transfer nip the balled up replacement fluid is leveled and acts as a lubricating film. An ink jet deposition head 42 can be used to deposit the replacement fluid based on the data used to create the inked image (e.g., in coordination with optical patterning subsystem 22). Such an arrangement is shown in FIG. 5.

Returning again to FIG. 1, in the description above, dampening fluid extraction subsystem 26 and replacement fluid delivery subsystem 28 are described and shown as separate, independent subsystems. However, it will be understood that in certain embodiments, these subsystems may be part of a single replacement fluid subsystem. Similarly, while reservoir 40 and recycling apparatus 42 have been described as independent elements, they too may form elements of a single replacement fluid subsystem. Alternatively, a single replacement fluid subsystem may include dampening fluid extraction subsystem 26, replacement fluid delivery subsystem 28, and recycling apparatus 42 directly connected to dampening fluid extraction subsystem 26 without reservoir 40. The replacement fluid subsystem may be an upgrade to existing variable data lithography systems, which are retrofitted to accept the replacement fluid subsystem, or may form a designed-in element of a variable data lithography system.

The replacement fluid coats (at least partially) the surface of print image carrier 12 exposed between the ink regions 36, but does not wet inked regions 36. The replacement fluid may then act as a lubricant (together with the ink) to reduce wear of surface 13 at the interface between print image carrier 12 and substrate 14 (i.e., caused by the relative surface roughness of substrate 14).

Accordingly, print image carrier 12, with ink regions 36 separated by replacement fluid, and substrate 14 are then brought into physical contact at nip 16. Adequate pressure is applied between print image carrier 12 and impression roller 18 such that the ink in ink regions 36 is brought into physical contact with substrate 14. Adhesion of the ink to substrate 14 and strong internal cohesion cause the ink to separate from print image carrier 12 and adhere to substrate 14. Impression roller 18 or other elements of nip 16 may be cooled to further enhance the transfer of the ink to substrate 14. Indeed, substrate 14 may itself be maintained at a relatively colder temperature than the ink on print image carrier 12, or locally cooled, to assist in the ink transfer process. The ink can be transferred off of print image carrier 12 with greater than 95% efficiency as measured by mass, and can exceed 99% efficiency with system optimization.

Some replacement fluid may also wet substrate 14 and separate from print image carrier 12. However, the volume of transferred replacement solution will be relatively small, and it will rapidly evaporate or be absorbed within substrate 14.

Carrier cleaning subsystem 30 then removes the balance of the replacement fluid and any residual ink from print image carrier 12, preferably without scraping or wearing surface 13. An air knife with sufficient airflow can easily and quickly remove most if not all of the replacement fluid. Ideally, the replacement fluid is a low cost, environmentally benign material, and any fluid not removed by the air knife will simply evaporate. Accumulated replacement fluid can also safely be disposed of, following filtering out of ink or other contaminants if needed. The overall volume of excess replacement fluid remaining after a printing cycle in quite small, but a reservoir (not shown) may be provided for accumulating the fluid at the cleaning stage.

Residual ink may be removed using a sticky, tacky belt, roller or similar apparatus. Again, the printing efficiency is quite high in systems of the type described herein, so the volume of residual ink is quite small for a printing cycle. However, any residual ink may accumulate on a dedicated member in a variable lithography system, which may be a consumable element of such as system and periodically replaced or cleaned.

Figure 6:
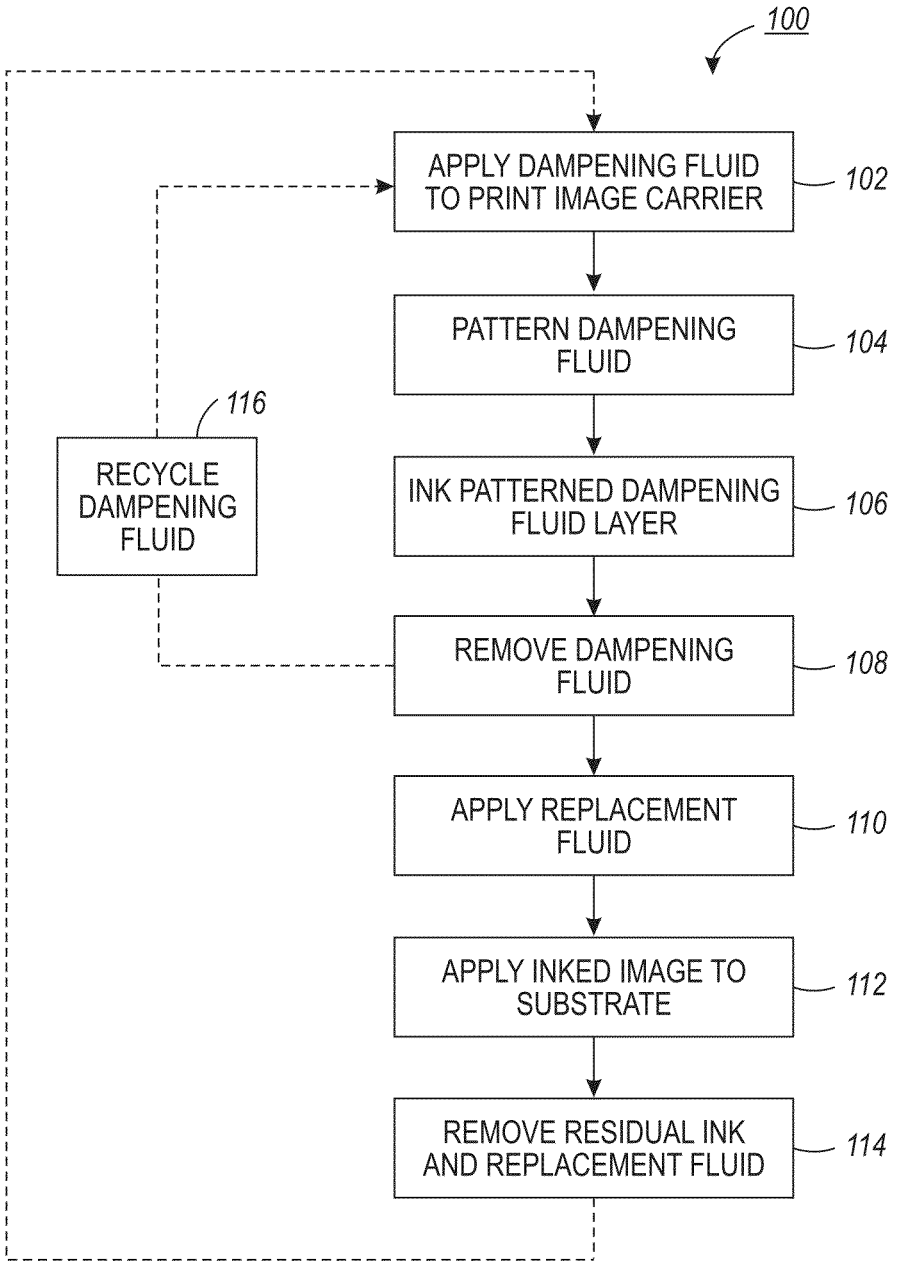
FIG. 6 is a flow chart illustrating steps in a process for operating a variable data lithographic system with replacement fluid replacing dampening solution post-inking, according to an embodiment of the present disclosure.

Steps of a method 100 such as described above are illustrated in FIG. 6. A dampening fluid layer is applied to the surface of a print image carrier at 102. The dampening fluid layer is patterned at 104. The patterned dampening fluid layer is inked at 106. The dampening fluid is removed at 108 and replaced with replacement fluid at 110. The inked image is transferred to a substrate at 112. The surface of a print image carrier is cleaned of residual ink and replacement fluid at 114, and optionally the process begins again for a new image. Optionally, the removed damping fluid is appropriately treated so that it may be recycled at 116, then reapplied to the surface of a print image carrier at 102.

A system having a single imaging cylinder, without an offset or blanket cylinder, is shown and described herein. In such an embodiment, the print image carrier surface may be made from material that is conformal to the roughness of print media via a high-pressure impression cylinder, while it maintains good tensile strength necessary for high volume printing. Traditionally, this is the role of the offset or blanket cylinder in an offset printing system. However, requiring an offset roller implies a larger system with more component maintenance and repair/replacement issues, and increased production cost, added energy consumption to maintain rotational motion of the drum (or alternatively a belt, plate or the like). Therefore, while it is contemplated by the present disclosure that an offset cylinder may be employed in a complete printing system, such need not be the case. Rather, the print image carrier surface may instead be brought directly into contact with the substrate to affect a transfer of an ink image from the reimageable surface layer to the substrate. Component cost, repair/replacement cost, and operational energy requirements are all thereby reduced.

The physics of modern electrical devices and the methods of their production are not absolutes, but rather statistical efforts to produce a desired device and/or result. Even with the utmost of attention being paid to repeatability of processes, the cleanliness of manufacturing facilities, the purity of starting and processing materials, and so forth, variations and imperfections result. Accordingly, no limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "as nearly as practicable", "within technical limitations", and the like.

Furthermore, while a plurality of exemplary embodiments have been presented in the foregoing detailed description, it should be understood that a vast number of variations exist, and these exemplary embodiments are merely representative examples, and are not intended to limit the scope, applicability or configuration of the disclosure in any way. Various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described embodiments may be made without departing from the spirit and scope of the disclosure defined by the claims thereto.

What is claimed is:

1. A variable data printing system, comprising:

a print image receiving surface;

a dampening fluid deposition subsystem disposed such that dampening fluid deposited thereby may be deposited onto said print image receiving surface;

an patterning subsystem disposed to form a pattern in said dampening fluid on said print image receiving surface, said pattern comprising a plurality of discrete regions of dampening fluid, with adjacent regions of dampening fluid separated by gaps that correspond to portions of an image to be printed to a substrate;

an inker subsystem disposed to deposit ink over said print image receiving surface preferentially in said gaps;

a dampening fluid extraction subsystem disposed such that dampening fluid disposed on said print image receiving surface may be removed therefrom with no more than minimal modification to said ink deposited in said gaps;

a replacement fluid deposition subsystem disposed such that replacement fluid deposited thereby may be deposited onto said print image receiving surface preferentially in regions formerly occupied by said dampening fluid prior to its removal by said dampening fluid extraction subsystem, said replacement fluid deposited with no more than minimal modification to said ink deposited in said gaps;

a print image transfer subsystem for transferring said ink on said print image receiving surface to said substrate; and a cleaning subsystem for removing residual ink and replacement fluid remaining on said print image receiving surface following transferring said ink on said print image receiving surface to said substrate at said print image transfer subsystem.

2. The replacement fluid subsystem of claim 1, further comprising:

a reservoir, communicatively coupled to said dampening fluid extraction subsystem for receiving and storing dampening removed by said dampening fluid extraction subsystem.

3. The variable data printing system of claim 1, further comprising:

a recycling apparatus, communicatively coupled to said dampening fluid extraction subsystem, for treating dampening removed by said dampening fluid extraction subsystem so that said dampening fluid deposition subsystem may deposit said treated dampening fluid onto said print image receiving surface.

4. The variable data printing system of claim 3, wherein said recycling apparatus is communicatively coupled to said dampening fluid deposition subsystem such that dampening fluid treated by said recycling apparatus may be deposited onto said print image receiving surface thereby.

5. The variable data printing system of claim 4, wherein said recycling apparatus is configured to treat said dampening fluid by removing ink and other contaminants therefrom.

6. The variable data printing system of claim 1, wherein said dampening fluid extraction subsystem comprises an air knife.

7. The variable data printing system of claim 1, wherein said dampening fluid extraction subsystem comprises a vacuum system.

8. The variable data printing system of claim 1, wherein said replacement fluid deposition subsystem comprises a roller application system for applying said replacement fluid to said print image receiving surface.

9. The variable data printing system of claim 1, wherein said replacement fluid deposition subsystem comprises a spray application system for applying said replacement fluid to said print image receiving surface.

10. A method of operating a variable data lithographic printing system, comprising:

forming a dampening fluid layer on a print image receiving surface;

forming a pattern in said dampening fluid layer, said pattern comprising a plurality of discrete regions of dampening fluid, with adjacent regions of dampening fluid separated by gaps that correspond to portions of an image to be printed to a substrate;

depositing ink over said print image receiving surface preferentially in said gaps;

removing said dampening fluid disposed on said print image receiving surface with no more than minimal modification to said ink deposited in said gaps;

depositing a replacement fluid onto said print image receiving surface preferentially in regions formerly occupied by said dampening fluid prior to its removal, said replacement fluid deposited with no more than minimal modification to said ink deposited in said gaps;

transferring said ink on said print image receiving surface to said substrate; and removing residual ink and replacement fluid remaining on said print image receiving surface following transferring said ink to said substrate.

11. The method of claim 10, wherein said removed dampening fluid is recycled and made available to for again forming a dampening fluid layer on said print image receiving surface.

* * * * *